US006016617A

United States Patent [19]

Adler

[11] Patent Number: 6,016,617

[45] Date of Patent: Jan. 25, 2000

[54] SIGN AND SUSPENSION APPARATUS FOR A SULKY HARNESS

[76] Inventor: Anders Adler, Farmorsbacke 7, SE-197 93, Bro, Sweden

[21] Appl. No.: 09/194,153

[22] PCT Filed: Jun. 3, 1997

[86] PCT No.: PCT/SE97/00976

§ 371 Date: Nov. 23, 1998

§ 102(e) Date: Nov. 23, 1998

[87] PCT Pub. No.: WO97/46992

PCT Pub. Date: Dec. 11, 1997

[30] Foreign Application Priority Data

Jun. 3, 1996 [SE] Sweden ..... 9602224

[51] Int. Cl.[7] ..... G09F 3/00; A62B 35/00

[52] U.S. Cl. ..... 40/303; 40/300; 119/858

[58] Field of Search ..... 40/300, 303, 617, 40/658, 604; 54/1, 2; 119/858

[56] References Cited

U.S. PATENT DOCUMENTS

| | | | |
|---|---|---|---|
| 440,306 | 11/1890 | Durning | 40/303 |
| 545,752 | 9/1895 | Underwood | 40/303 |
| 1,782,193 | 11/1930 | Callen . | |
| 2,114,135 | 4/1938 | Butler | 40/303 |
| 2,125,768 | 8/1938 | Christensen et al. | 40/300 X |
| 2,327,824 | 8/1943 | Schacht | 40/300 |
| 2,539,098 | 1/1951 | Pettigrew | 40/303 |
| 2,539,810 | 1/1951 | Butler . | |
| 2,764,830 | 10/1956 | Frey | 40/604 |
| 3,564,743 | 2/1971 | Gilmoure | 40/604 |
| 4,599,012 | 7/1986 | Kugler et al. | 40/406 X |
| 4,612,719 | 9/1986 | De Jong | 40/300 X |
| 5,173,144 | 12/1992 | Chapman et al. | 40/604 X |

FOREIGN PATENT DOCUMENTS

| | | | |
|---|---|---|---|
| 127938 | 6/1948 | Austria | 40/303 |
| 9104496 | 7/1991 | Germany . | |
| 3572 | 5/1892 | Sweden | 40/303 |

OTHER PUBLICATIONS

Trav Och Galoppronden, 1997, NR. 27, Jul. 4, 1997.

*Primary Examiner*—Anthony Knight
*Assistant Examiner*—Marcus Dolce
*Attorney, Agent, or Firm*—Dowell & Dowell, P.C.

[57] ABSTRACT

A sign and suspension apparatus for mounting to a harness for a carriage such as a sulky. The apparatus includes a sign that is secured by first and second attachment elements which extend from a back portion of the sign outwardly beyond upper and lower edges thereof to points of connection with the harness. A separate security attachment element is secured through a conduit at the rear of the sign and is selectively connected to a point of attachment with the harness.

8 Claims, 1 Drawing Sheet

SIGN AND SUSPENSION APPARATUS FOR A SULKY HARNESS

BACKGROUND OF THE INVENTION

1. Field of the Invention

The present invention relates to a suspension device for a sign adapted to be fastened onto a carriage, e.g. a sulky or similar being by means of thills attached within a harness.

2. Brief Description of the Related Art

During sulky sport competitions it is a well known problem for the spectator to see and distinguish the number of the competing carriage. Many attempts with signs have been made, which failed. The spectators need a sign well attached with an easily readable number to distinguish the carriages. The carriages need a durable sign being easily attachable to the equipment.

SUMMARY OF THE INVENTION

The present invention is directed to a sign and suspension apparatus which is adapted to securely mount the sign to the harness of a sulky. The sign includes a front number display portion and a rear portion and upper and lower edges. The suspension device includes first and second attachment elements which are connected to the back of the sign and which extend outwardly beyond the upper and lower edges thereof toward points of connection with an upper portion of a harness and a lower portion of a harness. At least one of the attachment elements is adjustable to ensure that the sign is tightly secured to the harness.

In a preferred embodiment of the invention, a security connecting element, such as a cord, is mounted through a tube mounted on the rear portion of the sign and includes an outer end which is selectively engaged at a point of connection with the harness.

Also, in the preferred embodiment, quick release snap hooks, or similar connectors, are used to secure each of the suspension elements to the harness.

Thus, the main object of the invention is to provide a device for attaching a sign onto to the horses harness, to visualize, which number the carriage in question has in the sulky sport competitions, the device complying with the demands stated above.

The object is achieved in that the suspension device is provided with the characteristics specified in the claims to follow.

BRIEF DESCRIPTION OF THE DRAWINGS

The invention will be described herein below in more detail in connection with the drawing.

DESCRIPTION OF THE PREFERRED EMBODIMENT

Figure 1:
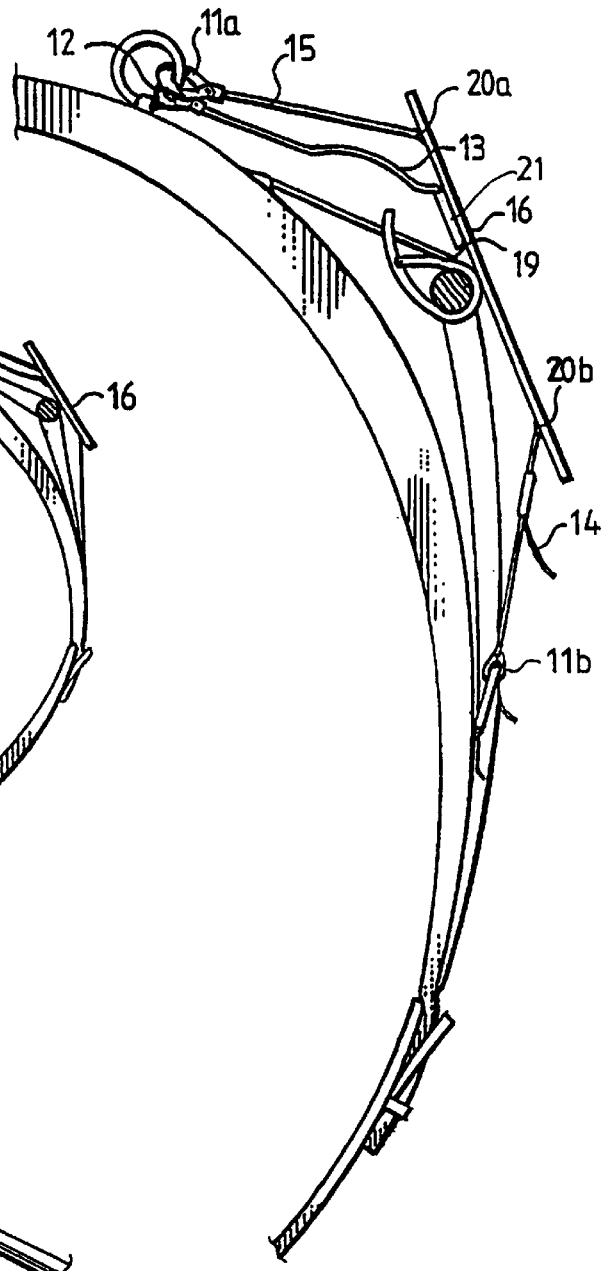
FIG. 1 shows an end view of the sign attachment on the side of the harness.
Figure 3:
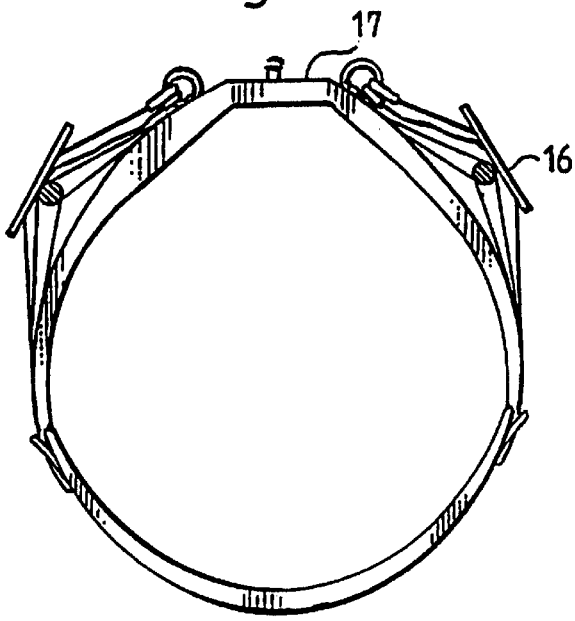
FIG. 3 shows the sign attachment to the harness on both sides of the harness.
Figure 2:
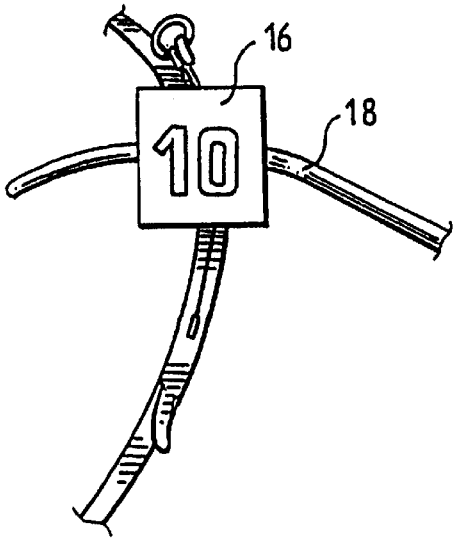
FIG. 2 shows the arrangement of the sign in relation to the horse.

The sign consists of a thin or panel 16 in a composite material. To achieve the possibly best durability and resilience 900 g of glass fibres were used in composition with 3×300 glass fibre tissues of a special polyester with the product number 48 M85. The surface was coated with an ENGA-gel coating, and an antireflecting creformer with the product number 10-80 makes the sign resilient. The number is encased and formed within the gel coating or the sign is also alternatively adapted for attaching the number and/or the background by means of a film or is alternatively directly screen printed onto the sign. The sign is attached by means of a three point method, a band 15 being attached to a ring on the upper part of the harness 17 with a definite length and a band 14 to a ring on be attached to the lower part of the harness 17. This band 14 is also adjustable to different sizes of the harness 17. The third band is a cord 13 attached between the sign 16 and the harness 17 as a security device to prevent any other parts to loosen. The bands 14, 15 are attached by means of snap hooks to the harness 17 and with plate buckles on the backside of the sign. The position of the sign relative to a sulky thill 18 and the harness is shown clearly in FIG. 2. The security cord 13 is running within a pipe 21 on the backside of the sign to achieve an easy replacement of the cord 13. The buckles and the pipe 21 are plasticized onto the backside of the sign 16 by means of a mixture of lime, glass fibres and glass fibre tissues with the product number 48 M85. The plasticize attachment for the buckle for the bands 14, 15 are shown at 20*a* and 20*b*. The mixture of glass fibres and lime provides the possibility to use it as a putty to smoothen the surface. The mixture can also withstand the resilience of the sign.

The embodiments here shown and described provide obviously only an example of the realization of the invention and changes might be provided within its scope. Thus, anyone of the bands 14, 15 might be adjustable, and the devices such as snap hooks 11*a*, 11*b* or 12 for an attachment to the carriage harness may be of any type whatsoever, preferably of a quick-coupling type. Moreover, other materials might be used than the stated ones to achieve an attachment of the buckles and the security cord to the backside of the sign.

I claim:

1. A sign and suspension apparatus for a harness associated with a sulky having thills which are connectable to the harness, the apparatus comprising: a sign panel having front and rear portions and upper and lower edges, a suspension means connectable to said sign panel to upper and lower portions of the harness, said suspension means including first and second attachment elements, at least one of said first and second attachment elements being adjustable in length, means for connecting said first and second attachment elements to the rear portion of said panel in spaced relationship to one another, said first attachment element being extendable beyond said upper edge of said panel and including a first connector adapted to connect said first attachment element to the upper portion of the harness and said second attachment element extending outwardly beyond said lower edge of said panel and including a second connector adapted to connect said second attachment element to the lower portion of the harness.

2. The sign and suspension apparatus of claim 1, including a conduit attached to said rear portion of said panel, a security cord extending through said conduit and extending rearwardly of said panel, and third connector means adapted to connect said security cord to the harness.

3. The sign and suspension apparatus of claim 2 in which said first, second and third connectors are quick connect couplings.

4. The sign and suspension apparatus of claim 1 in which said first and second connectors are quick connect couplings.

5. The sign and suspension apparatus of claim 2 in which said means for connecting said first and second attachment elements to said rear portion of said panel includes plasticizing a first end of each of said attachment elements into said rear portion of said panel using glass fiber tissue.

6. The sign and suspension apparatus of claim 5 wherein said panel is coated with a non-reflecting material.

7. The sign and suspension apparatus of claim 1 in which said means for connecting said first and second attachment elements to said rear portion of said panel includes plasticizing a first end of each of said attachment elements into said rear portion of said panel using glass fiber tissue.

8. The sign and suspension apparatus of claim 1 in which said panel is coated with a non-reflecting material.

* * * * *